United States Patent [19]

Sakai et al.

[11] 3,999,899

[45] Dec. 28, 1976

[54] DIAPHRAGM FLUID PUMP

[75] Inventors: Toshimitsu Sakai; Tadashi Saitou, both of Toyota; Isamu Suzuki, Aichi, all of Japan

[73] Assignees: Toyota Jidosha Kogyo Kabushiki Kaisha, Toyota; Aisan Kogyo Kabushiki Kaisha, Obu, both of Japan

[22] Filed: May 12, 1975

[21] Appl. No.: 576,368

[30] Foreign Application Priority Data

May 29, 1974 Japan ..... 49-60528

[52] U.S. Cl. ..... 417/471; 417/566; 92/85 R; 92/129

[51] Int. Cl.[2] ..... F04B 45/04; F01B 11/02

[58] Field of Search ..... 417/470, 566, 471, 412, 417/413; 92/129, 130 C, 99, 85 R

[56] References Cited

UNITED STATES PATENTS

| | | | |
|---|---|---|---|
| 2,185,784 | 1/1940 | Corydon | 92/99 |
| 2,293,542 | 8/1942 | Hamilton | 417/413 |
| 2,529,204 | 11/1950 | Van Ranst et al. | 417/471 |
| 2,653,544 | 9/1953 | Katcher | 417/470 |
| 2,747,789 | 5/1956 | Szerely | 417/413 |
| 3,025,551 | 3/1962 | Oishei | 417/328 |
| 3,039,127 | 6/1962 | Molenaal | 92/85 R |
| 3,186,349 | 6/1965 | Compton | 417/470 |
| 3,333,547 | 8/1967 | Compton | 417/471 |
| 3,807,281 | 4/1974 | Perkins | 92/85 R |

*Primary Examiner*—William L. Freeh
*Attorney, Agent, or Firm*—Stevens, Davis, Miller & Mosher

[57] ABSTRACT

In a diaphragm fluid pump, a pump housing comprises a cylinder provided therein coaxially with an operating rod of a diaphragm piston assembly hermetically assembled within the housing, and a driving mechanism for the operating rod includes a piston element mounted on the free end of the operating rod and slidably engaged within the cylinder to regulate the axial movement of the operating rod, whereby the diaphragm piston assembly is reciprocated without twisting thereof.

7 Claims, 3 Drawing Figures

DIAPHRAGM FLUID PUMP

BACKGROUND OF THE INVENTION

The present invention relates to a diaphragm fluid pump, and more particularly to an improvement of a diaphragm fluid pump driven by swinging movement of a rocker arm.

In related U.S. Pat. application Ser. No. 533,216, now U.S. Pat. No. 3,969,045 file on Dec. 16, 1974, the inventors disclosed a diaphragm fluid pump of the type having a diaphragm piston assembly hermetically assembled within a pump housing and reciprocated by a pump drive shaft by way of a rocker arm, and a pumping chamber defined by the diaphragm piston within the pump housing, wherein a cushioning material made of such a soft resilient material as rubber, soft synthetic resin or the like is integrally secured on the inner surface of the diaphragm piston assembly within the pumping chamber. This cushioning material functions to reduce the pumping chamber volume to a possible minimum on the arrival of the diaphragm piston at its upper dead point and also to absorb shocks produced when the diaphragm piston touches the inner wall of the pump housing.

Even with a diaphragm fluid pump of the abovementioned type, there is such a problem that when the operating rod of the diaphragm piston assembly wavers in its reciprocation, the cushioning material loses some of its buffer effect by its swingable engagement with the inner wall of the pump housing on the arrival of the diaphragm piston at its upper dead point; also the flexible diaphragm is twisted to lessen its durability.

SUMMARY OF THE INVENTION

The primary object of the present invention is to provide an improved diaphragm fluid pump, wherein an operating rod of a diaphragm piston assembly is regulated in its moving directions to reciprocate the diaphragm piston assembly without twisting movements thereof and further to secure the buffer function of a cushioning material provided on the diaphragm piston assembly.

According to the present invention, a pump housing comprises a cylinder provided therein coaxially with an operating rod of a diaphragm piston assembly hermetically assembled within the housing, and a driving mechanism for the operating rod includes a piston element mounted on the free end of the operating rod and slidably engaged within the cylinder to regulate the axial movement of the rod, whereby the diaphragm piston assembly is reciprocated without twisting thereof.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
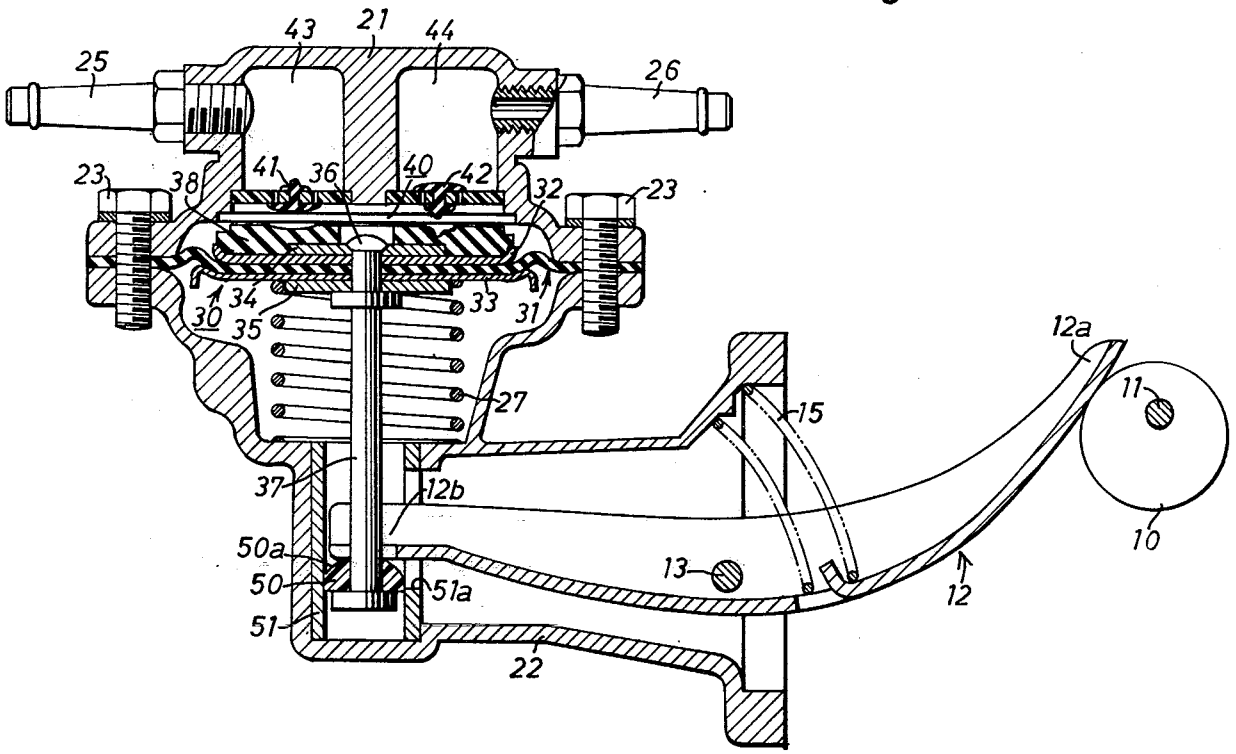
FIG. 1 is a view of vertical cross-section of a diaphragm fluid pump in accordance with the present invention.

Referring now to the drawings, particularly to FIG. 1, there is disclosed a preferred embodiment of a diaphragm fluid pump in accordance with the present invention. An eccentric cam 10 is fixed on a pump drive shaft 11 driven by the prime engine, not shown in the figure, of a vehicle. A rocker arm 12 is swingably journalled by way of a pivot pin 13 on the inner wall of a lower housing 22 of the fluid pump. The rocker arm 12 is assembled in such a manner that its outer and inner ends 12*a* and 12*b* are engaged respectively with the cam face of the eccentric cam 10 and the spherical upper face 50*a* of piston 50 which will be discussed later in detail. A compression spring 15 is interposed between a portion of the inner wall of the lower housing 22 and a portion of the rocker arm 12 to bias the rocker arm 12 clockwise in the figure.

The piston 50 is made of such slidable materials as polytetrafluoroethylene and other synthetic resins and mounted on the lower end of an operating rod 37. This piston 50 is slidably engaged within a cylinder sleeve 51 provided coaxially with the operating rod 37 in the lower housing 22, thereby to secure stable and straight axial reciprocation of the operating rod 37. Through the side-wall of the cylinder sleeve 51, there is drilled a slit 51*a* to permit vertical swing of the inner end 12*b* of the rocker arm 12 with its fulcrum at the pivot pin 13.

A diaphragm piston assembly 30 comprises substantially a flexible disc diaphragm 31 of which the outer rim is interposed and hermetically clamped between the jointing annular edges of an upper housing 21. The lower housing 22 and the operating rod 37 has its upper end fixed on the center of the disc diaphragm 31 by caulking 36 through upper and lower protector plates 32 and 33 and upper and lower washers 34 and 35. The upper and lower protector plates 32 and 33 are discs including annular flanges respectively bent upward and downward. On the upper protector plate 32, secured integrally is a disc cushioning material 38 having a predetermined thickness and a cross-section corresponding with the inner wall shape of the upper housing 21 and the bottom shapes of two check valves 41 and 42 assembled within the upper housing 21. Thus, the caulking top end 36 of the operating rod 37 and the upturned flange of the upper protector plate 32 are covered and prevented from projecting up the disc cushioning material 38.

A pumping chamber 40 is formed above the diaphragm piston assembly 30 and communicates with suction and discharge chambers 43 and 44 respectively through the suction and discharge check valves 41 and 42. The suction and discharge chambers 43 and 44 are provided respectively with an inlet port 25 connected to a vacuum cylinder, not shown in the figure, of a brake booster and the like and with an outlet port 26 which is constantly open to the atmospheric air. Under the diaphragm piston assembly 30, a coil spring 27 is interposed between the bottom face of the lower protector plate 33 and a lower inner wall of the lower housing 22 to bias the operating rod 37 upwardly.

In operation of the diaphragm fluid pump, rotation of the eccentric cam 10 driven by the prime engine of the vehicle swings vertically the rocker arm 12 with its fulcrum at the pivot pin 13 by way of engagement of the rocker arm 12 with the cam face of the eccentric cam 10 and resilient force of the springs 15 and 27, thereby to transmit torque of the drive shaft 11 to the piston 50. The swinging movement of the rocker arm 12 causes vertical reciprocation of the diaphragm piston assembly 30.

In the above-explained operation, the piston 50 is prevented from transverse or horizontal movements within the cylinder sleeve 51 and permitted only to vertically reciprocate. This allows the operating rod 37 to make its vertical reciprocation strictly along the axis thereof, thereby to reciprocate the diaphragm piston assembly 30 along the axis of the operating rod 37. Consequently, in the vertical reciprocation of the diaphragm piston assembly 30, the flexible diaphragm 31 or any portion thereof is not twisted but conducts its waving movements in accordance with the reciprocation of the piston assembly 30. In this instance, the cushioning material 38 also makes vertical reciprocation and has no swingable engagements with the upper inner wall of the housing 21 and the valves 41 and 42.

Through the above-mentioned operation, the suction check valve 41 is opened and the discharge check valve 42 is closed in response to the downward strokes of the diaphragm piston assembly 30, thereby to suck the air into the pumping chamber 40 by way of the inlet port 25, the suction chamber 43 and the suction check valve 41 in sequence. Meanwhile, the suction check valve 41 is closed and the discharge check valve 42 is opened in response to the upward strokes of the piston assembly 30. Thus, the air within the pumping chamber 40 is discharged into the atmospheric air through the discharge check valve 42, the discharge chamber 44 and the outlet port 26 in sequence, thereby to produce vacuum within the pumping chamber 40.

Figure 2:
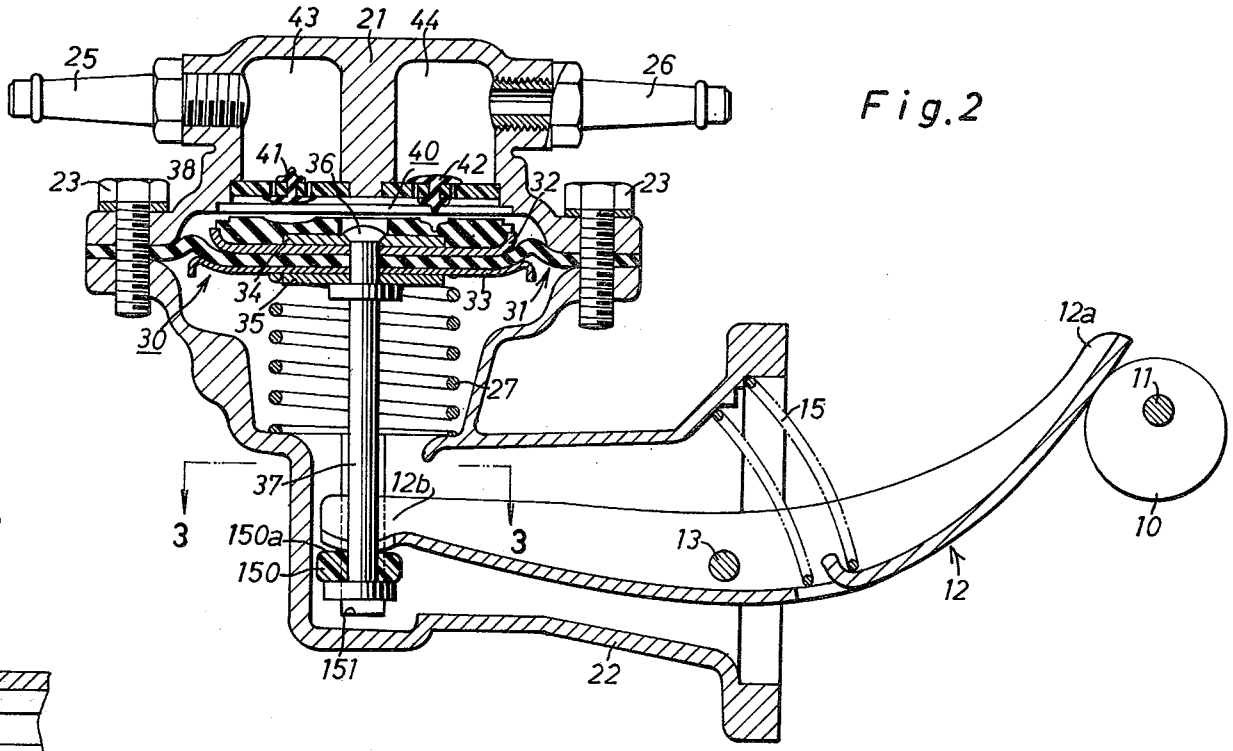
FIG. 2 depicts a vertical cross-section of a modification of the diaphragm fluid pump of FIG. 1.
Figure 3:
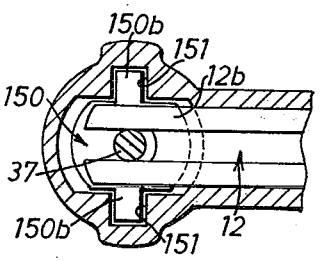
FIG. 3 is a cross-sectional plan view taken along line 3—3 in FIG. 2.

A modification of the above-disclosed embodiment is described hereinafter in reference to FIGS. 2 and 3. In this modification, the piston 50 mounted on the lower end of the operating rod 37 for securing the strict axial reciprocation of the piston assembly 30 in the previous embodiment is replaced with a piston 150 having a pair of radial projections **150*b* and 150*b*, as best shown in FIG. 3. This piston 150 is securedly mounted on the operating rod 37 and the radial projections 150*b* and 150*b* are slidably engaged respectively with a pair of guide grooves 151 and 151 vertically drilled on the inner wall of the lower housing 22 axially along the operating rod 37, the grooves 151 being crossed with the rocker arm 12** at a right angle.

Furthermore, adapted in the previous embodiment for the smooth engagement between the piston 50 and the inner end **12*b* of the rocker arm 12 is the spheric shape to the upper face 50*a* of the piston 50, the bottom face of the inner end 12*b* of the rocker arm 12 being formed flat. The upper face 50*a* of the piston 50 may, however, be formed flat and the bottom face of the inner end 12*b* of the rocker arm 12** may be formed in a spherical shape, or both of the portions may be spherically formed. And it should be recognized that the present invention can be applied to other types of fluid pumps as well as vacuum pumps.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A diaphragm vacuum pump for a vehicle, including a pump housing mounted on a body portion of the vehicle and including thereon an inlet port connected to a pneumatically operated device and an exhaust port connected to the atmosphere; a diaphragm piston assembly hermetically assembled within said housing for forming a pressure reduction chamber at one side thereof, said chamber being connected respectively with said inlet and exhaust ports; valve means assembled within said chamber and including a suction valve to suck air from said pneumatically operated device into said chamber through said inlet port and an exhaust valve to discharge the sucked air externally through said exhaust port; an operating rod, connected at one end to said diaphragm piston assembly, for reciprocating said diaphragm piston assembly for subsequently producing vacuum in said pressure reduction chamber; a drive mechanism, including a rocker arm, driven by a prime engine of the vehicle for operating said operating rod; and a resilient means for biasing said diaphragm piston assembly to its upper dead point against operating torque from said drive mechanism by way of said operating rod, wherein the improvement comprises: a resilient cushion material integrally secured on said diaphragm piston assembly within said pressure reduction chamber and between said diaphragm piston assembly and said valve means to constantly minimize the volume of said chamber when said diaphragm piston assembly reaches its upper dead point and to absorb touching pressure against said valve means; a cylinder, within said pump housing, adjacent the other end of said operating rod and coaxial with said operating rod; and a piston means mounted on the other end of said operating rod and slidably engaged within said cylinder to permit only axial movement of said operating rod, said piston means being relatively swingably connected with said rocker arm.

2. A diaphragm fluid pump as claimed in claim 1, wherein said piston means is made of hand synthetic resin.

3. A diaphragm fluid pump as claimed in claim 1, wherein said resilient cushioning material is a soft synthetic resin plate having a predetermined thickness with a cross-section corresponding with the shape of the inner wall of said housing facing said diaphragm piston assembly.

4. A diaphragm fluid pump as claimed in claim 1, wherein said cylinder is a cylinder sleeve integrally assembled within said pump housing.

5. A diaphragm fluid pump as claimed in claim 4, wherein said piston means includes a spherical face engaged with the bottom face of said rocker arm.

6. A diaphragm fluid pump as claimed in claim 1, wherein said cylinder comprises a pair of guide grooves provided therein axially along said operating rod, said grooves facing opposite each other, and said piston means includes a pair of radial projections slidably engaged with said grooves respectively.

7. A diaphragm fluid pump as claimed in claim 6, wherein said rocker arm is provided with a spherical engaging portion engaged with said piston means.

* * * * *